US011239035B2

(12) United States Patent
Chen

(10) Patent No.: US 11,239,035 B2
(45) Date of Patent: Feb. 1, 2022

(54) BUTTON STRUCTURE AND DISPLAY DEVICE HAVING BUTTON STRUCTURE

(71) Applicants: K-TRONICS (SUZHOU) TECHNOLOGY CO., LTD., Jiangsu (CN); BOE TECHNOLOGY GROUP CO., LTD., Beijing (CN)

(72) Inventor: Lei Chen, Beijing (CN)

(73) Assignees: K-Tronics (Suzhou) Technology Co., Ltd., Jiangsu (CN); BOE Technology Group Co., Ltd., Beiiing (CN)

( * ) Notice: Subject to any disclaimer, the term of this patent is extended or adjusted under 35 U.S.C. 154(b) by 331 days.

(21) Appl. No.: 16/495,276

(22) PCT Filed: Apr. 24, 2019

(86) PCT No.: PCT/CN2019/084028
§ 371 (c)(1),
(2) Date: Sep. 18, 2019

(87) PCT Pub. No.: WO2019/223486
PCT Pub. Date: Nov. 28, 2019

(65) Prior Publication Data

US 2020/0381192 A1 Dec. 3, 2020

(30) Foreign Application Priority Data

May 25, 2018 (CN) ..... 201810517919.6

(51) Int. Cl.
*H01H 13/04* (2006.01)
*G08C 17/02* (2006.01)
(Continued)

(52) U.S. Cl.
CPC ..... *H01H 13/04* (2013.01); *G08C 17/02* (2013.01); *G08C 23/04* (2013.01); *H01H 13/14* (2013.01)

(58) Field of Classification Search
CPC ..... H01H 13/04; H01H 13/14; G08C 17/02; G08C 23/04; G06F 1/1626; G06F 1/1656;
(Continued)

(56) References Cited

U.S. PATENT DOCUMENTS

2014/0355196 A1* 12/2014 Hashimoto ..... G06F 1/1632 361/679.27
2015/0365508 A1* 12/2015 Kwon ..... H04M 1/0266 455/566
2017/0177037 A1* 6/2017 Koo ..... G06F 1/1616

FOREIGN PATENT DOCUMENTS

CN 2078064 U 5/1991
CN 201556554 U 8/2010
(Continued)

OTHER PUBLICATIONS

First Office Action for CN Appl. No. 201810517919.6, dated Apr. 23, 2019, 15 pages with English translation.
(Continued)

*Primary Examiner* — Orlando Bousono
(74) *Attorney, Agent, or Firm* — The Webb Law Firm

(57) ABSTRACT

The present disclosure relates to a button structure and a display device having the button structure. The button structure includes a housing, a function control substrate, a mechanical button and a remote control module. The housing has a reception space and a connection structure, is detachably connected to an electronic device through the connection structure, and has an installation surface to be docked to the electronic device, the installation surface is provided with a cable hole which communicates with the reception space, the electronic device is provided with a hole corresponding to the cable hole. The function control substrate is provided within the reception space and is connected with a cable, which extends into the electronic device
(Continued)

via the cable hole and the hole and is connected to an electronic element inside the electronic device.

17 Claims, 3 Drawing Sheets

(51) Int. Cl.
*G08C 23/04* (2006.01)
*H01H 13/14* (2006.01)

(58) Field of Classification Search
CPC ..... H04M 1/0262; H04M 1/0266; H04M 1/0274; H04M 1/0277
See application file for complete search history.

(56) References Cited

FOREIGN PATENT DOCUMENTS

| | | | |
|---|---|---|---|
| CN | 201667763 | U | 12/2010 |
| CN | 102693681 | A | 9/2012 |
| CN | 205081043 | U | 3/2016 |
| CN | 205812566 | U | 12/2016 |
| CN | 205911191 | U | 1/2017 |
| CN | 108008844 | A | 5/2018 |
| CN | 108511241 | A | 9/2018 |

OTHER PUBLICATIONS

Second Office Action for CN Appl. No. 201810517919.6, dated Dec. 17, 2019, 13 pages with English translation.

* cited by examiner

BUTTON STRUCTURE AND DISPLAY DEVICE HAVING BUTTON STRUCTURE

CROSS-REFERENCE TO RELATED APPLICATIONS

This application is a U.S. National Stage under 35 U.S.C. § 371 of International Application No. PCT/CN2019/084028, as filed on Apr. 24, 2019, which claims priority to Chinese Patent Application No. 201810517919.6 filed on May 25, 2018, and entitled "BUTTON STRUCTURE AND DISPLAY DEVICE HAVING BUTTON STRUCTURE". The disclosure of each of these applications is incorporated by reference herein in its entirety.

TECHNICAL FIELD

The present disclosure relates to a button structure and a display device having the button structure.

BACKGROUND

An existing display product such as a TV or a display, etc, pays more attention to a "human-oriented" design idea, the product needs to comply with various requirements such as esthetic requirements, individuation, thinness, functional requirements, etc. With the spread of the TV and the display, it is necessary to accomplish all-win of appearance and function in the design, cause an end consumer to use this kind of product efficiently, feel the convenience of "science and technology for the people". Based on the above mentioned product design demands, providing a button structure which integrates various control functions and also satisfies product appearance design requirements has become an important problem to be solved in the art.

SUMMARY

According to one aspect of the present disclosure, there is provided a button structure which is detachably installed to an electronic device. Wherein, the button structure includes a housing, a function control substrate, a mechanical button and a remote control module. The housing has a reception space and a connection structure, the housing is detachably connected to the electronic device through the connection structure, the housing has an installation surface which is to be docked to the electronic device, the installation surface is provided with a cable hole which communicates with the reception space, the electronic device is provided with a hole corresponding to the cable hole. The function control substrate is provided within the reception space and is connected with a cable, the cable extends into the electronic device via the cable hole and the hole and is connected to an electronic element inside the electronic device. The mechanical button is provided on the function control substrate and is exposed through a button hole provided in the housing. The remote control module is provided on the function control substrate so as to receive a remote control signal.

In some embodiments, the housing includes a first housing as well as a second housing. The first housing is provided with a reception recess and is provided with the connection structure. The second housing is detachably buckled to the first housing and seals the reception recess to form the reception space.

In some embodiments, the first housing includes a first part as well as a second part. The first part is provided with the reception recess. The second part is connected to the first part and is provided with the connection structure, and when the first housing is connected to the electronic device through the connection structure, the second part is located inside the electronic device.

In some embodiments, the first housing and the second housing are connected through a snap assembly, the snap assembly includes hooks and necks. The hooks are provided on one of the first housing and the second housing. The necks are provided in the other of the first housing and the second housing, the necks and the hooks cooperate by snap-fitting.

In some embodiments, the first housing is provided with multiple positioning posts, the positioning posts protrude from a recess bottom of the reception recess to a notch; the function control substrate is provided with multiple positioning holes, the multiple positioning holes respectively correspond to the multiple positioning posts, so that the positioning posts are set in the positioning holes to position the function control substrate within the reception recess.

In some embodiments, the housing has multiple sidewalls which surround a periphery of the installation surface, a surface of at least one sidewall of the multiple sidewalls has a shape which smoothly transitions to a surface of the electronic device.

In some embodiments, the connection structure is a screw lock hole, and the electronic device is provided with a screw hole corresponding to the screw lock hole, a fixed screw is commonly set in the screw lock hole and the screw hole, so that the housing is detachably connected to the electronic device.

In some embodiments, the remote control signal received by the remote control module comprises at least one of an infrared signal, a BLUETOOTH signal and a WIFI signal.

According to another aspect of the present disclosure, there is provided a display device comprising a casing as well as a display element provided within the casing. Wherein, the display device further includes the button structure proposed in the present disclosure and described in the above mentioned embodiment. Wherein, the housing is detachably connected to the casing through the connection structure, the casing is provided with the hole, the cable extends into the casing via the cable hole and the hole and is connected to the display element.

In some embodiments, the display element includes a backboard. Wherein, the connection structure extends into the interior of the casing and is detachably connected to the backboard.

BRIEF DESCRIPTION OF THE DRAWINGS

By considering the following detailed explanation of exemplary embodiments of the present disclosure in conjunction with the drawings, various goals, features and advantages of the present disclosure will become more apparent. The drawings are only exemplary diagrams of the present disclosure, and are not necessarily drawn to scale. In the drawings, the same reference numerals denote the same or similar components throughout. Wherein:

FIG. 1 is installed in a display.

DETAILED DESCRIPTION

Figure 1:
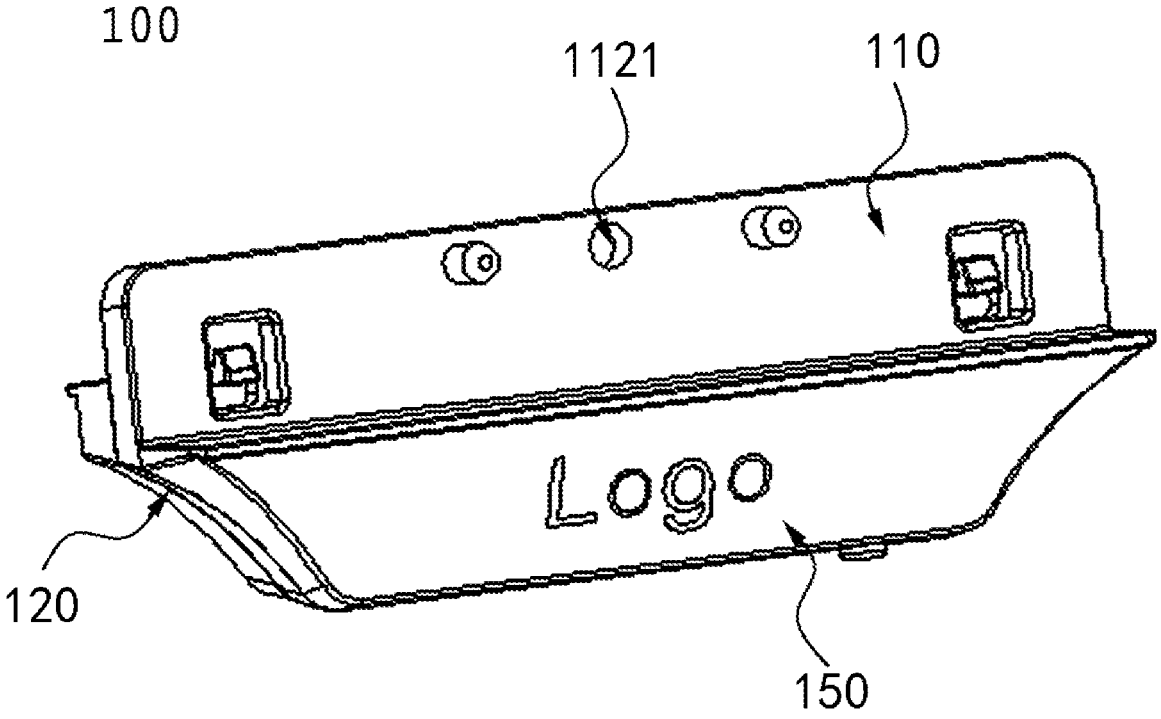
FIG. 1 is a structural diagram of a button structure shown according to an exemplary embodiment.

Typical embodiments which embody features and advantages of the present disclosure will be described in detail in the following explanation. It should be understood that, the present disclosure can have various modifications in different embodiments, none of which depart from the scope of the present disclosure, and the specification and the drawings therein are essentially for explanation, but not to limit the present disclosure.

The following description of different exemplary embodiments of the present disclosure is made with reference to the drawings, the drawings form a part of the present disclosure, and in the drawings, different exemplary structures, systems and steps which may embody various aspects of the present disclosure are shown in an exemplary manner. It should be understood that, other specific schemes of components, structures, exemplary devices, systems and steps may be used, and without departing from the scope of the present disclosure, structural and functional modifications may be made. Moreover, although terms "one side", "between", "within", etc, may be used in this specification to describe different exemplary features and elements of the present disclosure, but these terms are used herein only for convenience, e.g. describe directions of examples described in the drawings. Any content in the specification should not be understood to need specific three-dimensional directions of structures to fall within the scope of the present disclosure.

Embodiment of Button Structure

With reference to FIG. 1, it representatively shows a structural diagram of a button structure proposed in the present disclosure. In the exemplary embodiment, the button structure proposed in the present disclosure takes a button structure installed in a display device as an example, and further, takes a button structure installed in a display device, e.g., a TV or a display, as an example for explanation. Those skilled in the art may easily understand that, in order to apply relevant designs of the present disclosure to other types of display devices or other electronic devices, various modifications, additions, substitutions, deletions or other changes are made to the following specific embodiments, these changes are still within the scope of the principles of the button structure proposed in the present disclosure.

As shown in FIG. 1, the button structure 100 proposed in the present disclosure can be installed on a display device in a detachable manner. Wherein, the button structure 100 mainly includes a housing, a function control substrate, a mechanical button and a remote control module. The button structure 100 may include a logo pattern 150. The housing include a first housing 110 and a second housing 120.

Figure 2:
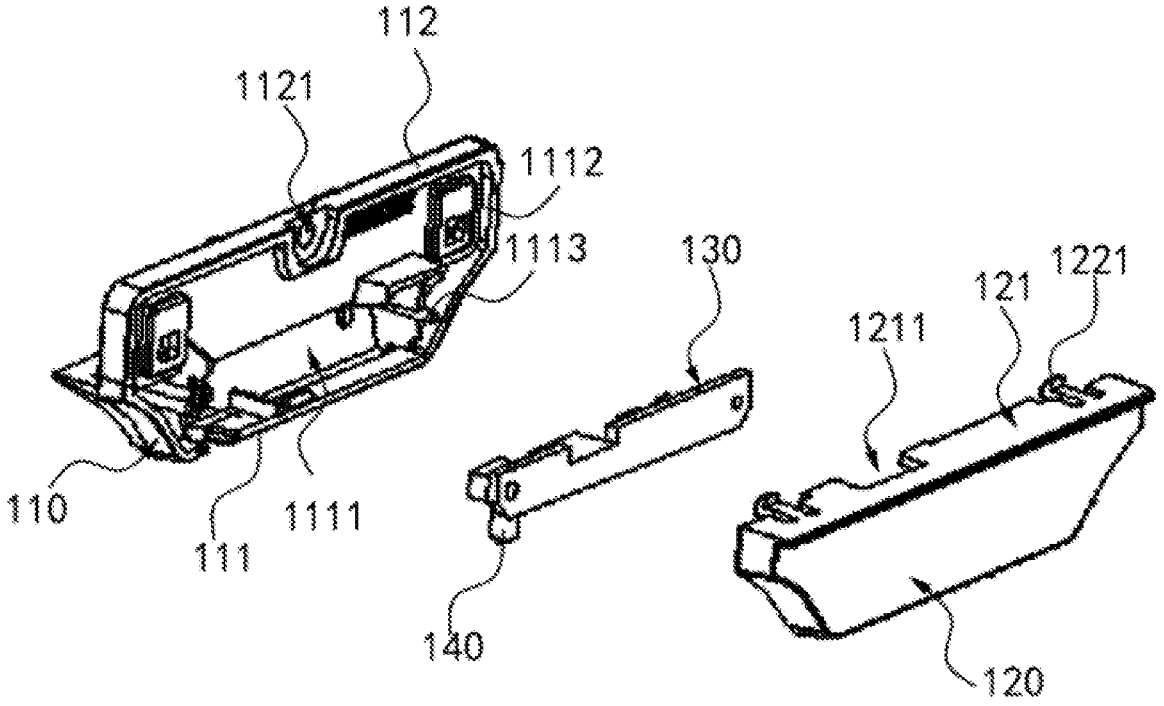
FIG. 2 is an exploded view of the button structure shown FIG. 1.
Figure 3:
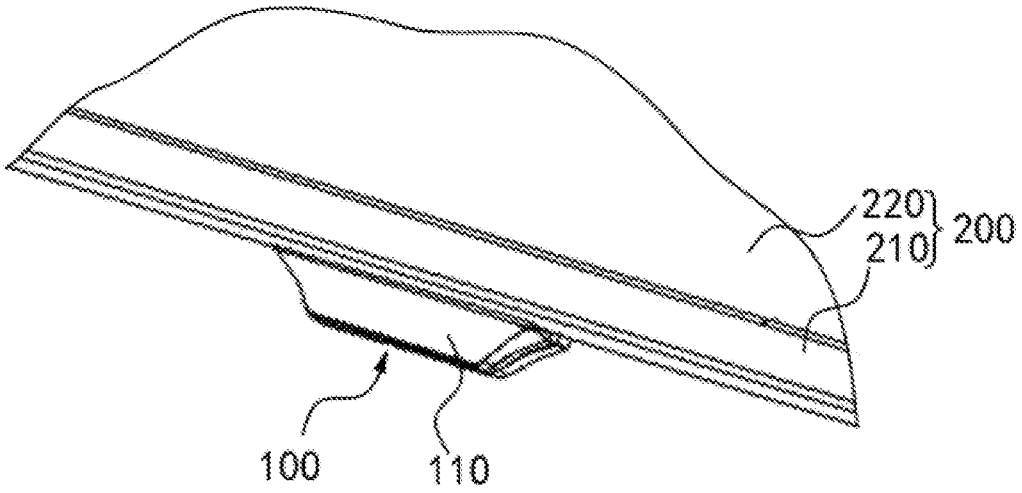
FIG. 3 is a structural diagram in which the button structure shown

Seeing FIG. 2 and FIG. 3 in cooperation with each other, FIG. 2 representatively illustrates an exploded view of the button structure 100 which can embody the principle of the present disclosure; FIG. 3 representatively illustrates a structural diagram in which the button structure 100 which can embody the principle of the present disclosure is installed in a display 200. Hereinafter, in conjunction with the above mentioned drawings, structures, connection methods and functional relations of respective main constituent parts of the button structure 100 proposed in the present disclosure are explained in detail.

As shown in FIG. 1 and FIG. 2, the housing has a reception space and a connection structure, the reception space is used to receive and install the function control substrate 130, the connection structure is used for the housing to be connected to the display device in a detachable manner. Wherein, the housing has an installation surface 121 which is to be docked to the display device, the installation surface 121 is provided with a cable hole 1211 which communicates with the reception space, the display device is provided with a hole corresponding to the cable hole 1211, and accordingly, cables which connect the function control substrate 130 and electronic elements inside the display device may directly go inside the display device via the above mentioned cable hole 1211 and the hole, will not be exposed outside the housing or the display device, satisfy special requirements for internal wiring of the display device, especially, e.g., the TV or the display 200, etc.

As shown in FIG. 2, the housing exemplarily adopts a structure design in which two-part structures are buckled and docked. Specifically, the housing includes the first housing 110 as well as the second housing 120. The first housing 110 is provided with a reception recess 1111 and is provided with a connection structure. The second housing 120 is detachably buckled to the first housing 110, and seals the reception recess 1111 to form the above mentioned reception space.

As shown in FIG. 2, the first housing 110 exemplarily includes a first part 111 as well as a second part 112. Specifically, the first part 111 is provided with the reception recess 1111, and the shape of the second housing 120 exemplarily adopts a design which is approximately the same as the shape of the first part 111 of the first housing 110. The second part 112 is connected to the first part 111 and is provided with a connection structure, and when the first housing 110 is connected to the display device via the connection structure, the second part 112 is located inside the display device.

Further, as shown in FIG. 2, the first housing 110 and the second housing 120 are exemplarily connected detachably by a snap assembly. Specifically, the snap assembly mainly includes multiple pairs of hooks 1221 as well as necks 1112. Wherein, the necks 1112 are set at one side of the first part 111 of the first housing 110 which is to be docked to the second housing 120, i.e., set at one side of a notch of the reception recess 1111 of the first part 111, the hooks 1221 are set at one side of the second housing 120 which is to be docked to the first housing 110, and the set positions of the hooks 1221 correspond to those of the necks 1112 one by one. In other embodiments, the set positions of the hooks 1221 and the set positions of the necks 1112 may be exchanged with each other, and the first housing 110 and the second housing 120 are not limited to be only provided with either of the hooks 1221 and the necks 1112. I.e. with respect to a pair of hook 1221 and neck 1112 which cooperate with each other, the hook 1221 is provided on either of the first housing 110 and the second housing 120, the neck 1112 is provided on the other of the first housing 110 and the second housing 120.

Further, as shown in FIG. 3, the display device has a front end face, a back end face, a top surface, a bottom surface and two side surfaces. On this basis, when it is assumed that the display device adopts a structure in which the front end face is provided with a screen 220 and the housing is connected to the bottom surface (or one of the top surface and the two side surfaces) of the display device with the installation surface 121, surfaces of sidewalls of the two sides of the housing respectively have shapes which smoothly transition to the bottom surface of the display device, e.g., an inclined plane, an inner concave cambered surface, etc, further improve an esthetic degree of the whole appearance. In other embodiments, when the button structure 100 is installed in other positions of the display device, of multiple sidewalls which the housing has and which surround the periphery of the installation surface 121, a surface of at least one sidewall may be designed to have a shape which smoothly transitions to the surface of the display device.

Further, as shown in FIG. 1 and FIG. 2, the connection structure exemplarily adopts a structure of a screw lock hole 1121, and accordingly, a screw hole corresponding to the screw lock hole 1121 is set inside the display device, a fixed screw (e.g. a M3*8 mechanical threaded screw) is commonly set in the screw lock hole 1121 and the screw hole, so that the housing of the connection structure is detachably connected to the display device.

As shown in FIG. 2, the function control substrate 130 is set within the reception space, it may select a structure of a commonly used circuit substrate such as a PVC board. The function control substrate 130 connects with electronic elements inside the display device through the cables. Specifically, one end of the cable is connected to the function control substrate 130, the other end extends into the display device via the cable hole 1211 and the hole, and is connected to the electronic element inside the display device. Accordingly, since the installation surface 121 of the housing is docked to the surface of the display device, and the cable hole 1211 corresponds to the opening to form a channel through which the cable extends, the cable is caused to not be exposed outside the housing or the display device, satisfy special requirements for internal wiring of the display device, especially, e.g., the TV or the display 200, etc.

Further, as shown in FIG. 2, the first housing 110 is provided with multiple positioning posts 1113, these positioning posts 1113 respectively protrude from the recess bottom of the reception recess 1111 to the notch. Accordingly, the function control substrate 130 is provided with multiple positioning holes, the multiple positioning holes respectively correspond to the multiple positioning posts 1113, so that the positioning posts 1113 are set through the positioning holes to position the function control substrate 130 within the reception recess 1111.

As shown in FIG. 2, the mechanical button 140 is set on the function control substrate 130 and is exposed outside the housing through a button hole provided in the housing, so that a user can directly contact and operate the mechanical button 140, to achieve a goal of controlling the display device. Wherein, the mechanical button 140 may be specifically chosen to be a press type or a touch control type, etc. In other embodiments, the number of the mechanical buttons 140 is not limited to one shown in the drawings, and may be adjusted flexibly according to different functional needs.

The remote control module is set on the function control substrate 130, so as to receive a remote control signal. Accordingly, by a combined design of the remote control module and the mechanical button 140, the button structure 100 proposed in the present disclosure can integrate various control functions, provide the user with various different operation experiences.

Further, the remote control signal received by the remote control module at least may include an infrared signal, a BLUETOOTH signal or a WIFI signal, etc, may also include a combination of the above mentioned various remote control signals.

As shown in FIG. 2 and FIG. 3, a logo pattern 150 is set on the housing, it can be used to display a product logo of the display device. Specifically, the logo pattern 150 may adopt printing, electroplating, sticking or welding, etc, to arrange the logo with a material such as metal or plastics, etc, on the housing. Moreover, the logo pattern 150 may also adopt a method of designing the housing to be a hollowed-out structure, and providing corresponding light source elements (e.g., LED lamp balls) exposed on the hollowed-out structure within the housing, to provide a light-emitting function, further improve the aesthetic degree.

Here, it is to be noted that, the button structures shown in the drawings and described in the specification are merely several examples of many button structures which can adopt the principle of the present invention. It should be clearly understood that, the principle of the present invention is, in no way, merely limited to any detail of the button structures or any component of the button structures shown in the drawings and described in the specification.

Embodiment of Display Device

With reference to FIG. 3, it representatively illustrates a structural diagram in which the button structure of the present disclosure is installed in a display, i.e., representatively illustrates an exemplary structure of a display device proposed in the present disclosure. In the exemplary embodiment, the display device proposed in the present disclosure takes a display as an example for explanation. Those skilled in the art may easily understand that, in order to apply relevant designs of the present disclosure to other types of display devices, various modifications, additions, substitutions, deletions or other changes are made to the following specific embodiments, these changes are still within the scope of the principles of the display device proposed in the present disclosure.

As shown in FIG. 3, the display device proposed in the present disclosure mainly includes a casing 210, a screen 220, a display element as well as the button structure 100 which is proposed in the present disclosure and is exemplarily explained in the above mentioned embodiment. Wherein, the display element is set inside the casing 210. The second part 112 of the first housing 110 of the button structure 100 extends into the interior of the casing 210 of the display device, the button structure 100 is detachably connected to the display 200 through the connection structure thereof. The casing 210 is provided with a hole, the cable extends into the interior of the casing 210 via the cable hole 1211 and the hole, and is connected to the display element.

Further, the display element includes a backboard, accordingly, the connection structure of the button structure 100 extends into the interior of the casing 210 and is detachably connected to the backboard. I.e. the backboard is provided with a screw hole, a fixed screw is set in the screw lock hole 1121 and the screw hole to connect the housing and the backboard.

Here, it is to be noted that, the display devices shown in the drawings and described in the specification are merely several examples of many button structures which can adopt the principle of the present invention. It should be clearly understood that, the principle of the present invention is, in no way, merely limited to any detail of the display devices or any component of the display devices shown in the drawings and described in the specification.

To sum up, with respect to the button structure and the display device having the button structure proposed in the present disclosure, by the design of "the button structure includes the mechanical button and the remote control module", the button structure integrates various operation and control functions of touch control operations and remote control operations. Meanwhile, by the design of "the logo pattern is provided in the housing" in the present disclosure, the button structure can simultaneously function as a decorative structure showing the product logo, satisfy requirements of the product appearance design. In addition, by the design of "the housing has the installation surface which is to be docked to the electronic device, the installation surface is provided with the cable hole which communicates with the reception space, the cable for functional control extends into the electronic device via the cable hole" in the present disclosure, the button structure can satisfy special design requirements for wiring of the electronic device, e.g., the TV or the display, etc.

Hereinabove, exemplary embodiments of the button structure and the display device having the button structure proposed in the present disclosure are described and/or shown in detail. But embodiments of the present disclosure are not limited to specific embodiments described herein, and instead, constituent parts and/or steps of each embodiment and other constituent parts and/or steps described herein may be used independently and separately. Each constituent part and/or each step of one embodiment may also be used in conjunction with other constituent parts and/or steps of other embodiments. Upon introduction of elements/constituent parts, etc, described and/or shown herein, phrases "one" and "the above mentioned", etc, are used to denote the presence of one or more elements/constituent parts, etc. Terms "contain", "include" and "have" are used to denote an open-ended inclusive meaning, and means that, in addition to the listed elements/constituent parts, etc, additional elements/constituent parts, etc, may be present. In addition, terms "first" and "second", etc, in claims and the specification are only used as marks, but not numerical limitations to their objects.

Although the button structure and the display device having the button structure proposed in the present disclosure have been described according to different specific embodiments, those skilled in the art will understand that changes may be made to embodiments of the present disclosure within the spirit and the scope of claims.

What is claimed is:

1. A button structure which is detachably installed to an electronic device, wherein the button structure comprises:

a housing having a reception space and a connection structure, the housing being detachably connected to the electronic device through the connection structure, the housing having an installation surface which is to be docked to the electronic device, the installation surface being provided with a cable hole which communicates with the reception space, the electronic device being provided with a hole corresponding to the cable hole;

a function control substrate provided within the reception space and connected with a cable, the cable extending into the electronic device via the cable hole and the hole and connected to an electronic element inside the electronic device;

a mechanical button provided on the function control substrate and exposed through a button hole provided in the housing; and a remote control module provided on the function control substrate so as to receive a remote control signal.

2. The button structure according to claim 1, wherein the housing comprises:

a first housing provided with a reception recess and provided with the connection structure; and a second housing detachably buckled to the first housing, and sealing the reception recess to form the reception space.

3. The button structure according to claim 2, wherein the first housing comprises:

a first part provided with the reception recess; and a second part connected to the first part and provided with the connection structure, and when the first housing is connected to the electronic device through the connection structure, the second part being located inside the electronic device.

4. The button structure according to claim 2, wherein the first housing and the second housing are connected through a snap assembly, the snap assembly comprises:

hooks provided on one of the first housing and the second housing; and necks provided in the other of the first housing and the second housing, the necks and the hooks cooperating with each other.

5. The button structure according to claim 2, wherein the first housing is provided with multiple positioning posts, the multiple positioning posts protrude from a recess bottom of the reception recess to a notch; the function control substrate is provided with multiple positioning holes, the multiple positioning holes respectively correspond to the multiple positioning posts, so that the multiple positioning posts are set in the multiple positioning holes to position the function control substrate within the reception recess.

6. The button structure according to claim 1, wherein the housing has multiple sidewalls which surround a periphery of the installation surface, a surface of at least one sidewall of the multiple sidewalls has a shape which smoothly transitions to a surface of the electronic device.

7. The button structure according to claim 1, wherein the connection structure is a screw lock hole, and the electronic device is provided with a screw hole corresponding to the screw lock hole, a fixed screw is commonly set in the screw lock hole and the screw hole, so that the housing is detachably connected to the electronic device.

8. The button structure according to claim 1, wherein the remote control signal received by the remote control module includes at least one of an infrared signal, a BLUETOOTH signal or a WIFI signal.

9. A display device comprising a casing as well as a display element provided within the casing, wherein the display device further includes the button structure according to claim 1; wherein the housing is detachably connected to the casing through the connection structure, the casing is provided with the hole, the cable extends into the casing via the cable hole and the hole and is connected to the display element.

10. The display device according to claim 9, wherein the display element includes a backboard; the connection structure extends into the interior of the casing and is detachably connected to the backboard.

11. The display device according to claim 9, wherein the housing comprises:

a first housing provided with a reception recess and provided with the connection structure; and a second housing detachably buckled to the first housing, and sealing the reception recess to form the reception space.

12. The display device according to claim 11, wherein the first housing comprises:

a first part provided with the reception recess; and a second part connected to the first part and provided with the connection structure, and when the first housing is connected to the electronic device through the connection structure, the second part being located inside the electronic device.

13. The display device according to claim 11, wherein the first housing and the second housing are connected through a snap assembly, the snap assembly comprises:

hooks provided on one of the first housing and the second housing; and necks provided in the other of the first housing and the second housing, the necks and the hooks cooperating with each other.

14. The display device according to claim 11, wherein the first housing is provided with multiple positioning posts, the multiple positioning posts protrude from a recess bottom of the reception recess to a notch; the function control substrate is provided with multiple positioning holes, the multiple positioning holes respectively correspond to the multiple positioning posts, so that the multiple positioning posts are set in the multiple positioning holes to position the function control substrate within the reception recess.

15. The display device according to claim 9, wherein the housing has multiple sidewalls which surround a periphery of the installation surface, a surface of at least one sidewall of the multiple sidewalls has a shape which smoothly transitions to a surface of the electronic device.

16. The display device according to claim 9, wherein the connection structure is a screw lock hole, and the electronic device is provided with a screw hole corresponding to the screw lock hole, a fixed screw is commonly set in the screw lock hole and the screw hole, so that the housing is detachably connected to the electronic device.

17. The display device according to claim 9, wherein the remote control signal received by the remote control module includes at least one of an infrared signal, a BLUETOOTH signal or a WIFI signal.

* * * * *